United States Patent [19]

Adas

[11] 3,944,024

[45] Mar. 16, 1976

[54] LADDER

[75] Inventor: Charles L. Adas, St. Clair Shores, Mich.

[73] Assignee: Detroit Marine Engineering, Detroit, Mich.

[22] Filed: Feb. 6, 1975

[21] Appl. No.: 547,572

[52] U.S. Cl. ..... 182/194; 182/206; 182/228; 403/376

[51] Int. Cl.[2] ..... E06C 7/08; E06C 9/02

[58] Field of Search ..... 182/228, 194, 206, 46, 182/47, 196; 256/65; 403/347, 376, 388

[56] References Cited

UNITED STATES PATENTS 3,078,955 2/1963 Rich ..... 182/206

FOREIGN PATENTS OR APPLICATIONS 1,175,422 11/1958 France ..... 182/46

1,006,702 10/1965 United Kingdom ..... 182/228

*Primary Examiner*—Reinaldo P. Machado

*Attorney, Agent, or Firm*—Harness, Dickey & Pierce

[57] ABSTRACT

A ladder is made from extruded aluminum steps supported on a pair of vertical tubes fitted through large diameter holes drilled vertically through the steps. The steps are hollow except for a pair of vertical walls extending longitudinally thereof and lying on opposite sides of the vertical holes. Small horizontal holes are drilled through these walls from the rear of the steps to receive fastening pins which are driven through the tubes to locate and support the steps on the tubes.

6 Claims, 3 Drawing Figures

FIG. 1.
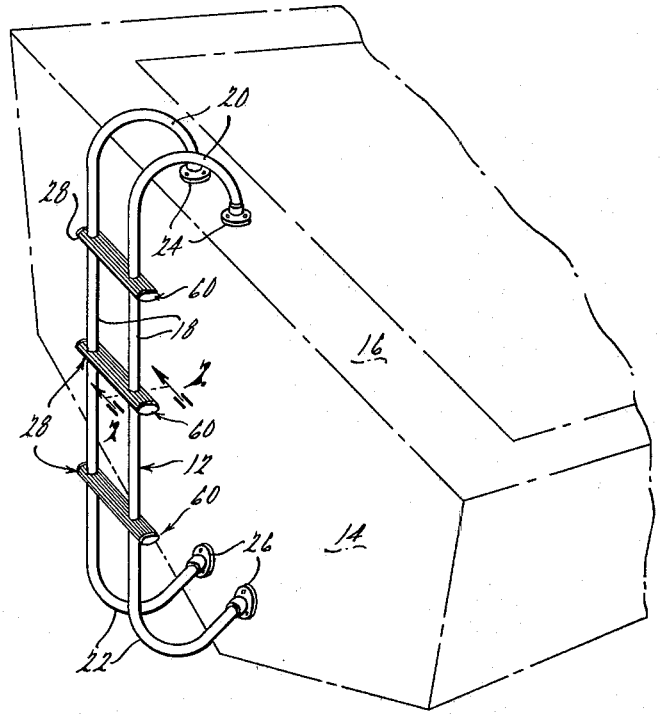
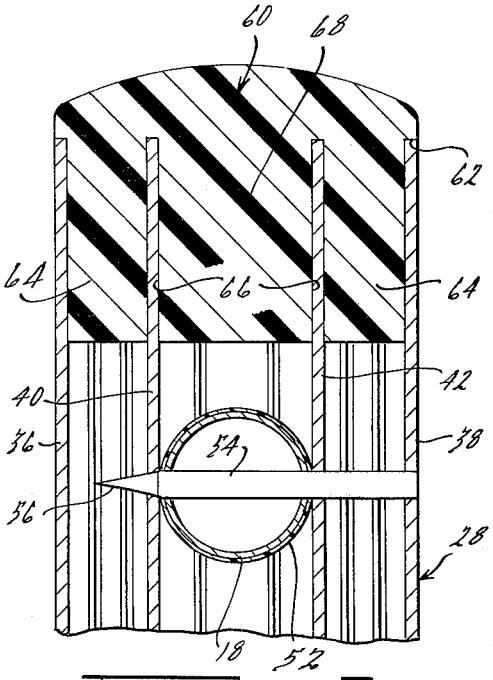
FIG. 3.
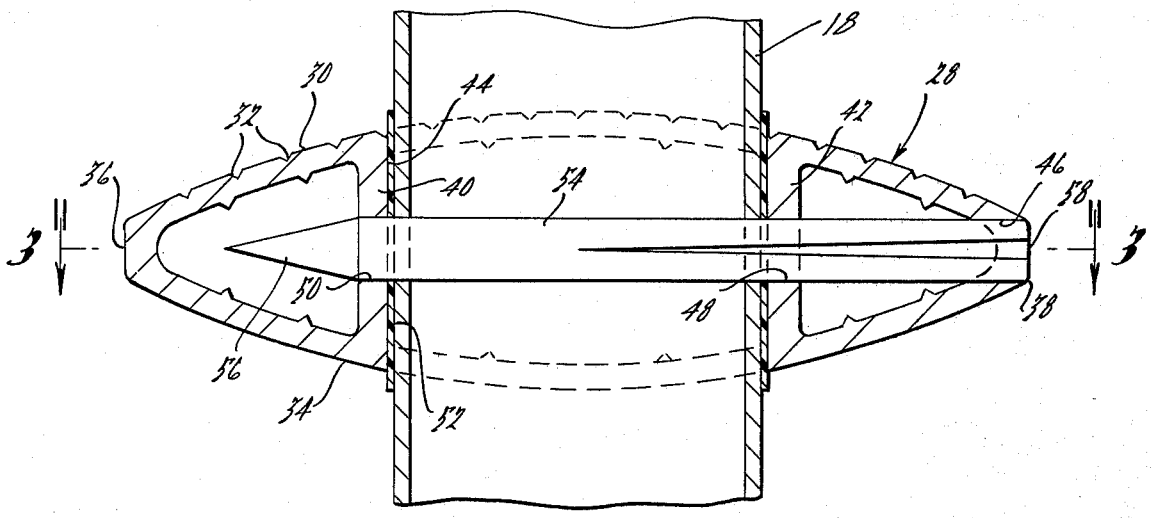
FIG. 2.

LADDER

SUMMARY OF THE INVENTION

While not limited to marine usage, the device of the present invention finds particular utility as a boat ladder. Boat ladders have traditionally been made with steps constructed of a variety of materials such as teak, metal stampings, metal castings and plastic moldings. Each of such materials has presented problems in durability, cost, appearance, assembly and strength. The ladder of the present invention is particularly designed to utilize steps made from extrusions of aluminum or other light weight material. The steps are cut to length and are closed at their opposite ends by means of plastic plugs or end fittings. The steps are also drilled vertically to accommodate tubular aluminum side rails which form the vertical supports of the ladder. Small horizontal holes are drilled through the walls of the steps to accommodate and guide nail-like pins which are driven through the tubular side rails to locate the steps on the side rails. Split plastic bushings are fitted between the tubular side rails and the walls of the vertical holes drilled through the steps. By this means, the vertical holes in the steps may be made slightly oversized, thereby permitting the steps to be slid over preformed side rails having bends and other non-rectilinear shapes imparted thereto prior to the assembly of the steps onto the side rails.

The ladder of the present invention is believed to have distinct cost advantages over other high quality ladders, such cost advantages stemming from both the use of somewhat lower priced materials as well as from the ease which the ladder is assembled. The ladder is highly durable and strong in construction and is attractive in appearance. The ladder is also safe and comfortable to use, presenting no jagged edges or other irregular projections to catch on the clothing or skin of a user.

DESCRIPTION OF THE VIEWS OF THE DRAWING

FIG. 1 is a perspective view of a boat ladder constructed in accordance with the principles of the present invention, the ladder being mounted on the stern of a boat which is illustrated in broken lines;

FIG. 2 is an enlarged sectional view of the structure illustrated in FIG. 1; and FIG. 3 is a reduced sectional view of the structure illustrated in FIG. 2.

DETAILED DESCRIPTION

FIG. 1 shows a boat ladder 12 constructed according to the present invention mounted at its lower end on a boat transom 14. The upper end of the ladder is connected to the rear deck 16 of the boat. The ladder includes a pair of vertical supports or tubular side rails 18 having reversely bent upper end portions 20 and curved lower end portions 22. The side rails 18 are preferably made from anodized aluminum tubing. The side rail upper end portions 20 are connected to the deck 16 by means of fittings 24 while the curved lower end portions 22 are connected to the transom 14 by fittings 26. A plurality of identical treads or steps 28 are secured to the side rails 18 in vertically spaced parallel relationship. The steps 28 are identical to one another and the manner of connection of each step to each side rail is identical. Accordingly, a description of one of the steps 28 and its manner of connection to one of the rails 18 will serve to illustrate all steps and their connection to both side rails 18.

Turning now to FIGS. 2 and 3, the steps 28, which are made from anodized extruded aluminum, each have an arcuate upper wall 30 provided with external traction grooves 32 and an arcuate lower wall 34. The walls 30 and 34 are connected by a front vertical wall 36 and a rear vertical wall 38 extending longitudinally of the step. Also connecting the walls 30 and 34 are a front inner vertical wall 40 and a rear inner wall 42. The steps 28 are hollow except for the walls 36 and 38. A pair of holes 44 are drilled vertically through the steps 28 in locations which lie between the walls 40 and 42 and are spaced from the opposite ends of the step. The holes 44 are of cylindrical shape and possess diameters slightly greater than the outer diameters of the tubular side rails 18. The diameters of the holes 44 are also approximately equal to the spacing between the inner walls 40 and 42.

For the purpose of joining the steps 28 to the side rails 18, each step is drilled twice, the drill entering the step from the rear wall 38 in vertical planes including the axes of the holes 44. This drilling operation results in the formation of three aligned horizontal holes 46, 48 and 50 formed in the walls 38, 42 and 40 respectively. Once the steps 28 have each been drilled to form the two vertical holes 48 and the two sets of horizontal holes 46, 48 and 50, the steps are fitted over the ends of said rails 18. This may be done from the lower ends 22 prior to the assembly of the lower ends to the fittings 26. Each step 28 is then moved to its proper position on the side rails 18, this operation being facilitated by the use of appropriate fixtures (not shown) to position the parts. Circumferentially split plastic sleeves or bushings 52 are then inserted between the outer peripheries of the side rails 18 and the walls of the vertical holes 44. The bushings 52 take up the clearance between the parts and prevent any horizontal "play" between the steps 28 and the side rails 18. Stainless steel pins 54 are then inserted into the holes 46 and 48 and are driven through the bushings 52 and side rails 18 and then pass through the holes 50. This is facilitated by the formation of pointed ends 56 on the pins 54. The pins 54 are driven into the steps until their flat outer ends 58 align with the outer surface of the rear wall 38. The pins 58, which are made of stainless steel, are easily able to pierce the bushings 52 and side rails 18. The holes 46, 48 and 50 may be sized slightly under the diameter of the pin 54 to insure proper frictional retention of the pin 54 in place within the step. It will be noted, however, that the holes 46 and 48 form guides for the pins 54 to insure its proper placement.

Either before or after the assembly of the steps 28 onto the side rails 18, the opposite ends of the steps may be closed by plastic plugs or end fittings 60. The plugs 60 have peripheral flanges 62 which seat against the opposite ends of the steps and cover any sharp surfaces thereon which may have been left from the sawing of the steps to length. The plugs 60 also have a pair of spaced outer projections 64 and a central inner projection 68 separated from the outer projections 64 by means of slots 66. The slots 66 accommodate the walls 40 and 42. The projections 64 and 68 are driven tightly within the hollow interior of the steps 28 to frictionally retain the plugs 60 in place.

As will be apparent to those acquainted with marine hardware, the side rails 18 may be made from the same tubular material as is utilized to construct the hand rails (not shown) which are frequently mounted on the rear deck of a boat. In that case, the side rails would simply constitute downward continuations of the same tubes from which the deck rails were formed. It is a particular advantage of the present invention that the tubing from which the side rails 18 are made may be bent and formed to the desired shape prior to the assembly of the steps 28 thereon. It will be apparent that while the ladder of the present invention is shown in the form of a boat ladder, the invention is equally applicable to ladders designed for non-marine usage.

It is to be noted that the inner step walls 40 and 42 are parallel to each other, extend for the entire length of the step 28 and serve several functions. In the first place they reinforce the step 28 and provide the step with resistance to deflection under the load of a user. Secondly, they provide the walls in which the fasteners or pins 54 are received and thus form a part of the connection between the steps 28 and the side rails 18. Because the steps 28 are not solid in construction but are hollow, their cost is reduced, they are light in weight, and both the drilling of the steps and the driving of the pins 54 therein is facilitated. The steps are easily anodized after their extrusion and they will retain an attractive appearance for a long time. The assembly of the steps 28 to the side rail 18 is particularly convenient and minimizes the cost of the ladder.

What is claimed is:

1. A ladder including a plurality of steps each having top and bottom walls and a pair of inner transverse walls extending between said top and bottom walls, a pair of vertical openings extending through said steps between said vertical walls, a pair of tubular side rails fitted in the vertical openings of each of said steps, and fastener means projecting through said step transverse walls and each of said side rails to support and locate said steps on said side rails.

2. The structure set forth in claim 1 in which said steps constitute metallic extrusions.

3. The structure set forth in claim 1 in which the spacing between said transverse walls is substantially equal to the span of said vertical openings.

4. The structure set forth in claim 1 in which said fastener means comprises a driven pin passing through preformed openings in said step transverse walls.

5. The structure set forth in claim 1 in which said steps comprise metallic extrusions and including resinous plastic plugs frictionally fitted into the ends of said steps and closing said ends.

6. The structure set forth in claim 1 including circumferentially split bushings fitted between said side rails and said transverse walls.

* * * * *